US006906582B2

(12) United States Patent
Kase et al.

(10) Patent No.: US 6,906,582 B2
(45) Date of Patent: Jun. 14, 2005

(54) CIRCUIT VOLTAGE REGULATION

(75) Inventors: Kiyoshi Kase, Austin, TX (US); May Len, Cedar Park, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 10/652,530

(22) Filed: Aug. 29, 2003

(65) Prior Publication Data

US 2005/0046467 A1 Mar. 3, 2005

(51) Int. Cl.[7] ..... G05F 1/10
(52) U.S. Cl. ..... 327/541; 327/540; 323/316
(58) Field of Search ..... 327/538, 540, 327/541, 543, 313, 315; 323/313, 316

(56) References Cited

U.S. PATENT DOCUMENTS 5,335,203 A * 8/1994 Ishii et al. ..... 327/543
5,506,541 A * 4/1996 Herndon ..... 327/541
5,903,182 A 5/1999 Jordan
6,222,357 B1 * 4/2001 Sakuragi ..... 323/315
6,388,508 B1 * 5/2002 Kawasumi ..... 327/543
6,642,699 B1 * 11/2003 Gregoire, Jr. ..... 323/314

* cited by examiner

*Primary Examiner*—Terry D. Cunningham
(74) *Attorney, Agent, or Firm*—Michael P. Noonan; David G. Dolezal; Michael Balconi-Lamica

(57) ABSTRACT

In a circuit including a number of functional blocks of circuits, each block having a minimum operating voltage, a plurality of sense lines from each of the blocks is used to measure local voltage fluctuation at each block. The power voltage(s) of the overall circuit may be globally regulating in the circuit responsive to such locally sensed voltage fluctuations to prevent the local voltages from dropping below the minimum operating voltage for each block.

26 Claims, 3 Drawing Sheets

CIRCUIT VOLTAGE REGULATION

BACKGROUND

1. Field

The present invention relates to circuitry operation control techniques and apparatus, and, more particularly, to such techniques and apparatus for regulation of voltage in a circuit (e.g., integrated circuit voltage regulation).

2. Description of the Related Art

Integrated circuits typically include a plurality of functional circuit blocks which perform different functions at different times causing a differing degree of power drain in different areas of the integrated circuit. When one functional block is particularly active, a local drop in voltage may be experienced at that location in the integrated circuit. Such functional blocks typically have a minimum operating voltage. If the local voltage drops below the minimum operating voltage, a processing failure is likely to occur. Accordingly, there is a need for an innovation which allows the system to detect voltage usage at various locations throughout the integrated circuit in question, and/or to compensate for local voltage variations within an integrated circuit.

BRIEF DESCRIPTION OF THE DRAWINGS

The present invention may be better understood, and its numerous objects, features, and advantages made apparent to those skilled in the art, by referencing the accompanying drawings. The use of the same reference symbols in different drawings indicates similar or identical items.

DETAILED DESCRIPTION OF THE PREFERRED EMBODIMENT(S)

The following discussion is intended to provide a detailed description of at least one example of the invention and should not be taken to be limiting of the invention itself. Rather, any number of variations may fall within the scope of the invention which is properly defined in the claims following this description.

Figure 1:
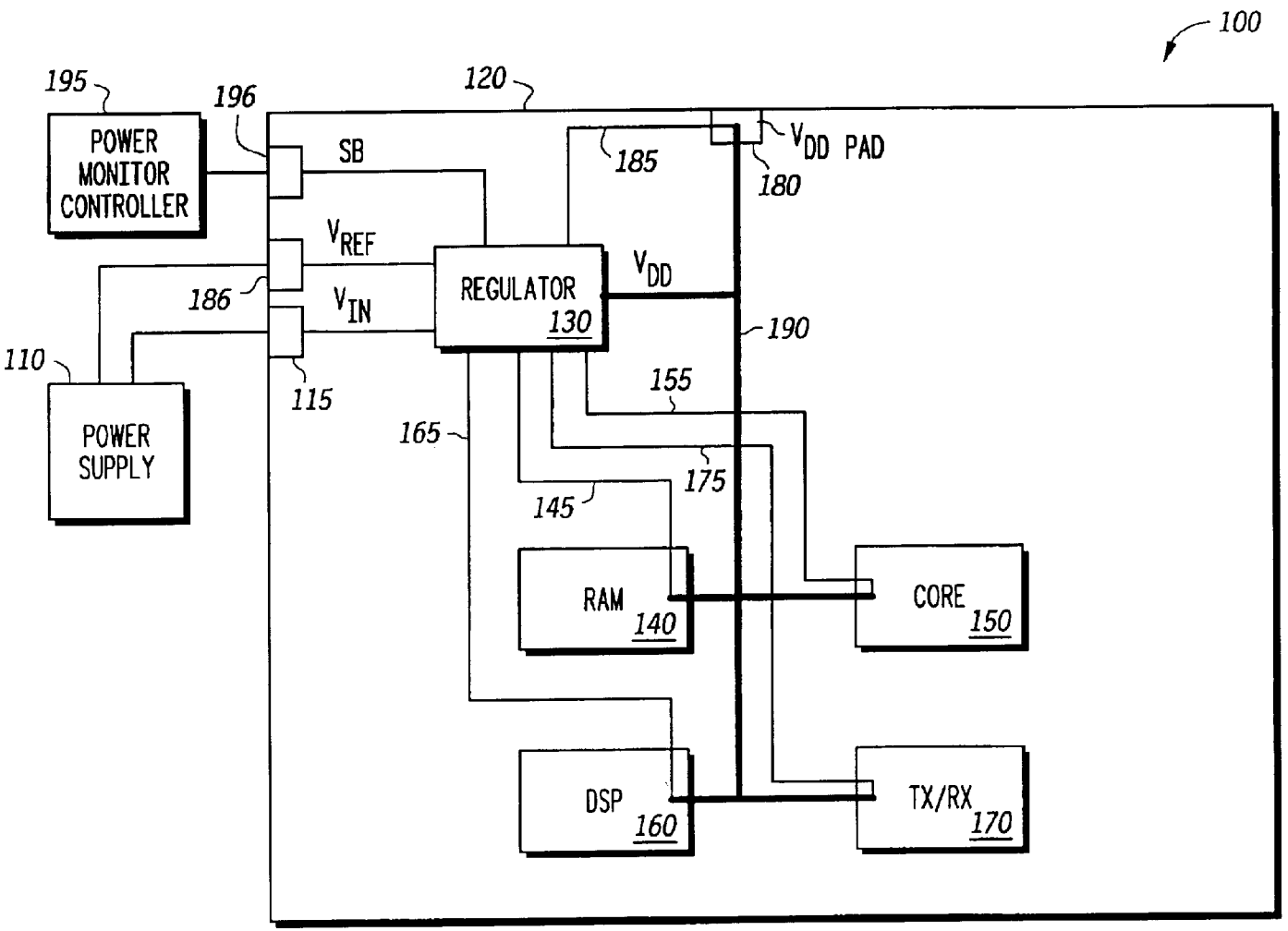
FIG. 1 is a block diagram illustrating an exemplary architecture of a system including circuit voltage regulation according to an embodiment of the invention.

FIG. 1 shows an exemplary electrical system and/or information processing system 100. System 100 includes power supply 110, power monitor controller 195 and integrated circuit (IC) 120, among other system elements. System 100 is representative of any information processing system. For example, in one embodiment, system 100 is a cell phone including a baseband processor (including, for example, IC 120), an RF frontend and a power management chip (including, for example, power monitor controller 195).

Power supply 10 provides an input power voltage $V_{IN}$ to IC 120 via power input pad 115. The power voltage $V_{IN}$ is a voltage from which a power rail voltage (e.g., $V_{DD}$ 190) is derived for operational circuits within IC 120. Power supply 110 also provides a reference voltage $V_{REF}$ via reference voltage input pad 186. Reference voltage $V_{REF}$ corresponds to a minimum operational power voltage below which operational circuitry of system 100 may not operate. For example, $V_{REF}$ may be equal to the minimum operation power voltage, or $V_{REF}$ may have a value related or proportional to the minimum operation power voltage. Although $V_{REF}$ is illustrated as being received from power supply 110, $V_{REF}$ may alternatively be derived from one or both of $V_{IN}$ and $V_{DD}$. For example, in one embodiment $V_{REF}$ is derived from $V_{IN}$ at all times. In another embodiment, $V_{REF}$ is derived from $V_{IN}$ during startup and from $V_{DD}$ after startup or during normal operation. Typically, $V_{IN}>V_{REF}$. In one embodiment, $V_{IN}$=1.875V, and $V_{REF}$=1.575V.

The reference voltage $V_{REF}$ is used as a reference signal to regulate the power rail voltage $V_{DD}$ which is derived from $V_{IN}$. The power rail voltage $V_{DD}$ will be taxed in different ways in different portions of IC 120 depending on the changing states of operation of the portions of IC 120. Comparisons of actual, localized $V_{DD}$ values with $V_{REF}$ may be used to regulate the degree to which $V_{DD}$ is tied to $V_{IN}$ in order to regulate the localized $V_{DD}$ values, (e.g., in a closed loop).

Power monitor controller 195 controls power saving operations of system 100. For example, power monitor controller monitors the power consumption and operational state of system 100, and may, for example, force system 100 into a standby mode to save power. Power monitor controller provides a standby (SB) signal to IC 120 via standby pad 196.

Integrated circuit 120 includes a number of operational circuits such as voltage regulation circuit 130, memory 140 (e.g., DRAM, SRAM or other appropriate memory type), processing core 150, digital signal processor (DSP) 160 and transmitter/receiver (Tx/Rx) 170. Each of the operational circuits 140, 150, 160, 170 are coupled to voltage regulation circuit 130 via power rail 190. Each of the operational circuits 140, 150, 160, 170 are also coupled to voltage regulation circuit 130 via sense lines 145, 155, 165, 175.

Power is received via power input pad 115 and transferred throughout IC 120 via power rail 190. Power rail 190 is representative of conventional integrated circuit power rails. In the presently discussed embodiment, power rail 190 includes multiple power grid lines and connectors which carry a power voltage $V_{DD}$ to various operational circuits of IC 120.

As discussed above, IC 120 includes a plurality of sense lines 145, 155, 165, 175 and 185. Each sense lines carries an indication of a measurement of a voltage level at various points of power rail 190. For example, sense line 145 carries an indication of a power voltage level at memory 140, sense line 155 carries an indication of a power voltage level at core 150, sense line 165 carries an indication of a power voltage level at DSP 160, sense line 175 carries an indication of a power voltage level at transmitter/receiver 170, and sense line 185 carries an indication of a power voltage level at $V_{DD}$ pad 180. Thus, voltage regulation circuit 130 receives in parallel a substantially contemporaneous measurement/indication of power voltage levels at various locations throughout IC 120.

Each of operational circuits 140, 150, 160, 170 typically requires a minimum power voltage supplied to it to operate effectively. In operation, different ones of operational circuits 140, 150, 160 and 170 will draw different amounts of power. For example, during a particularly memory intensive operation memory 140 may require more power than the rest of the operational circuits. In such a case, the actual power voltage $V_{DD}$ at memory 140 may tend to be drawn lower than the actual power voltage $V_{DD}$ at other operational circuits. Such a drop in local $V_{DD}$ would be indicated via sense line 145 to voltage regulation circuit 130. Voltage regulation circuit 130 uses the voltage indications received via the multiple sense lines 145, 155, 165, 175 and 185 to correct for dropping $V_{DD}$ at any particular operational circuit, and can therefore correct for the exemplary voltage drop tendency at memory 140. For example, regulator 130 corrects for such a local drop in $V_{DD}$ by effecting a global change in $V_{DD}$. By increasing $V_{DD}$ output to power rail 190 by regulator 130, the local $V_{DD}$ s are increased, with a resulting increase in the local $V_{DD}$ at memory 140, thereby ensuring that the local $V_{DD}$ at memory 140 does not drop below $V_{REF}$.

Figure 2:
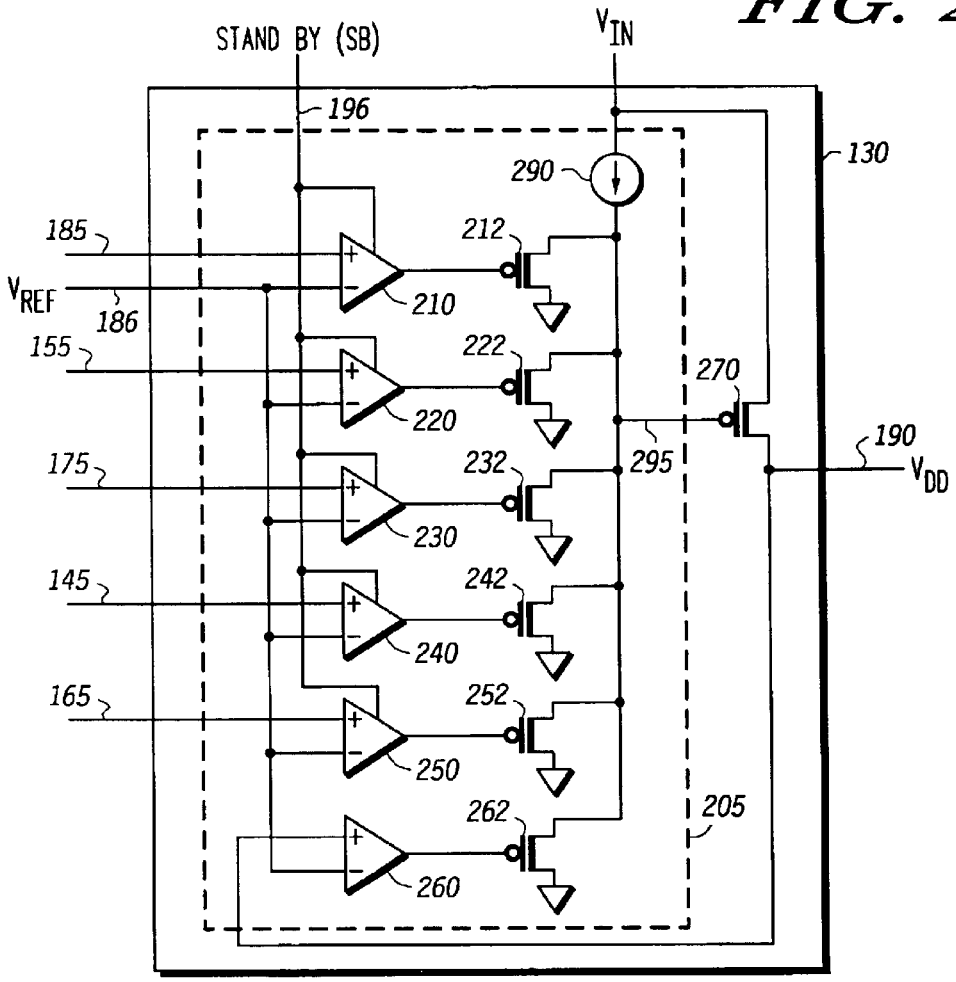
FIG. 2 is a circuit schematic illustrating an exemplary embodiment of the regulator of FIG. 1.

FIG. 2 shows an exemplary voltage regulation circuit 130. Voltage regulation circuit 130 includes a voltage regulator control circuit 205 and a regulator 270. Minimum voltage detection circuit 205 detects voltage fluctuations (e.g., a lowering of $V_{DD}$) at remote sensing locations in IC 120, and provides a signal indicative of the most significant fluctuation (e.g., lowest fluctuation) of the sensed voltages. Regulator 270 modifies $V_{DD}$ depending on the value of the signal indicative of the fluctuation.

Minimum voltage detection circuit 205 includes a sense circuit portion for comparing indications of remote voltages and a minimum voltage detection portion for providing a control signal 295 to the regulator 270 responsive to the comparison(s). As shown, the sense circuit portion of voltage regulator control circuit 205 includes operational amplifiers (opamps) 210, 220, 230, 240, 250 and 260, and the minimum voltage detection portion of voltage regulator control circuit 205 includes minimum voltage controllers (e.g., transistors) 212, 222, 232, 242, 252 and 262.

Each of the opamps 210, 220, 230, 240, 250 and 260 receives a reference voltage $V_{REF}$ on node 186 at an inverting input. Each of the opamps receives a remote voltage sense indication via one of sense lines 185, 155, 175, 145, and 165 at a non-inverting input. (Other embodiments may include configurations in which the inputs are swapped.) Each received remote voltage sense indication is an indication of a voltage which is remote from voltage regulation circuit 130 but local to each of a plurality of sense locations. The sense locations are typically at an operational circuit, pad location or other circuit location. As illustrated, opamp 210 receives sense line 185 indicating a remote voltage indication from $V_{DD}$ pad 180, opamp 220 receives sense line 155 indicating a remote voltage indication from core 150, opamp 230 receives sense line 175 indicating a remote voltage indication from Tx/Rx 170, opamp 240 receives sense line 145 indicating a remote voltage indication from RAM 140, opamp 250 receives sense line 165 indicating a remote voltage indication from DSP 160. Also as illustrated, opamp 260 receives a sense line corresponding to a regulator local $V_{DD}$ (that is, the $V_{DD}$ value substantially close to the output from, and therefore local to, voltage regulation circuit 130).

Voltage regulator control circuit 205 may also be conceived of as including a number of sense cells, each sense cell including a sense portion (e.g., opamp) and a priority portion (e.g., pull-down PMOS transistor), wherein the priority portions vie for priority control of the control signal 295 depending on the relative values of sensed voltages. Each priority PMOS transistor is controllable to pull control line 295 down when the sensed voltage corresponding to the priority circuit is pulled down. In this way, the priority cell corresponding to the sensed voltage which decreases the most has the most pull down effect on control line 295, thereby turning on the PMOS transistor of regulator 270, which ties $V_{DD}$ more directly to $V_{IN}$, thereby raising all local values of $V_{DD}$.

As illustrated, regulator 270 is a PMOS transistor which controllably ties $V_{DD}$ to $V_{IN}$. Regulator 270 includes a current handling terminal (source) which is coupled to $V_{IN}$, a current handling terminal (drain) which is coupled to $V_{DD}$, and a control terminal which is coupled to voltage control node 295. The extent to which regulator 270 conducts is controlled by the voltage on voltage control node 295. When regulator 270 ties $V_{DD}$ to $V_{IN}$ fully (is fully conducting), $V_{DD}=V_{IN}$. Typically, $V_{DD}$ is at a value below that of $V_{IN}$. $V_{DD}$ need only be raised to a higher value closer to $V_{IN}$ when there is a local fluctuation of $V_{DD}$. For example, if a localized value of $V_{DD}$ is pulled lower due to intensified localized power drain by a particular operational circuit, the regulator output of $V_{DD}$ can be raised so that the lower remote value of $V_{DD}$ remains above a minimum operational value for the operational circuit in question. In this case, regulator 270 is controlled by voltage regulator control circuit 205 to conduct to a greater extent so that there is less voltage drop over regulator transistor 270 and $V_{DD}$ is raised, thereby raising the remote but localized value of $V_{DD}$ which would otherwise decrease if left unregulated.

Figure 3:
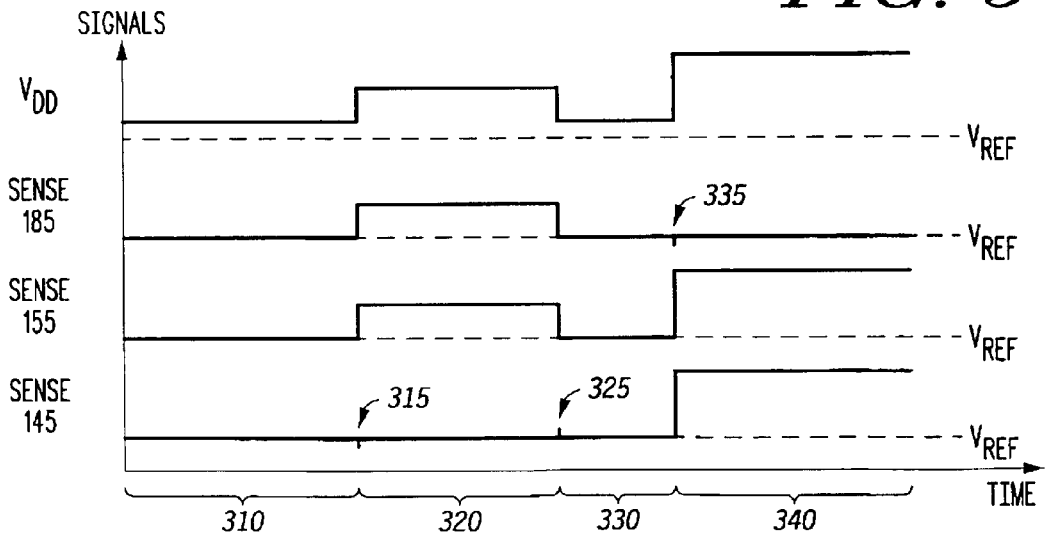
FIG. 3 is a timing diagram illustrating an exemplary timing of various signals within the system of FIG. 1.

FIG. 3 is a timing diagram showing exemplary remote $V_{DD}$ sense indications 185, 155 and 145. Each of the illustrated remote $V_{DD}$ sense indications corresponds to one of the sense lines illustrated in FIG. 2. As shown in FIG. 2 and discussed above, sense 185 corresponds to a sense line sensing a localized $V_{DD}$ at $V_{DD}$ pad 180 (pad $V_{DD}$), sense 155 corresponds to a sense line sensing a localized $V_{DD}$ at core 150 (core $V_{DD}$), and sense 145 corresponds to a sense line sensing a localized $V_{DD}$ at RAM 140 (RAM $V_{DD}$).

During time 310, all of the sensed locations have normal (operational) values of $V_{DD}$. At time 315, a pull-down fluctuation of $V_{DD}$ at the remote location sensed by sense 145 is detected. For example, a memory intensive operation may be occurring, causing locally increased power drain by RAM 140. Before RAM $V_{DD}$ can be drawn below a value which would prevent operation of RAM 140, opamp 240 detects the fluctuation (indicated at time 315) on sense line 145 (in comparison to $V_{REF}$ on line 186; see FIG. 2) and more strongly turns on transistor 242, thereby drawing more current from node 295 and turning on regulator transistor 270 to raise the value of $V_{DD}$ output by voltage regulation circuit 130. Because $V_{DD}$ at the output of voltage regulation circuit 130 is raised at time 315, the core $V_{DD}$ (sense line 155) and the pad $V_{DD}$ (sense line 185) are raised, and the value of RAM $V_{DD}$ (sense line 145), remains at an operational value throughout period 320.

At time 325, the memory intensive operation terminates, thereby ending the additional draw of power by RAM 140. This would tend to increase the RAM $V_{DD}$ as shown at time 325, but an initial increase of RAM $V_{DD}$ is detected on sense line 145 by opamp 240, which in turn more strongly turns off transistor 242, thereby drawing less current from node 295 and allowing regulator transistor 270 to turn off (unless turned on by another localized $V_{DD}$ fluctuation) to allow the value of $V_{DD}$ output by voltage regulation circuit 130 to lower (unless the regulator $V_{DD}$ is raised by another localized $V_{DD}$ fluctuation). Because $V_{DD}$ at the output of voltage regulation circuit 130 is lowered at time 325, the core $V_{DD}$ (sense line 155) and the pad $V_{DD}$ (sense line 185) are lowered at time 325 and continue at normal operational values throughout period 330, and the value of RAM $V_{DD}$ (sense line 145) remains at an operational value throughout period 330.

During time 320, RAM 140 drew additional power from the $V_{DD}$ power rail, thereby causing the $V_{DD}$ power rail to increase to a higher voltage as shown in FIG. 3. This caused other localized $V_{DD}$ values to increase as well. For example, sense 155 and sense 185 increased with $V_{DD}$ because there was not a commensurate drop in voltage on their corresponding localized power rails (core $V_{DD}$ and pad $V_{DD}$) due to additional processing or power drain at either of pad 180 or core 150. Because RAM 140 was tending to draw down the value of RAM $V_{DD}$, and because voltage regulation circuit 130 was tending to draw the value of RAM $V_{DD}$ up by increasing global $V_{DD}$, the value of RAM $V_{DD}$ remained substantially the same as shown in the ideal simulation representation of FIG. 3.

During time 330, all of the sensed locations have normal (operational) values of $V_{DD}$. At time 335, a pull-down fluctuation of $V_{DD}$ at the remote location sensed by sense 185 is detected. For example, an external power intensive operation may be occurring, causing locally increased power drain at $V_{DD}$ pad 180. Before pad $V_{DD}$ can be drawn below a value which would cause operational problems, opamp 210 detects the fluctuation (indicated at time 335) on sense line 185 (in comparison to $V_{REF}$ on line 186; see FIG. 2) and more strongly turns on transistor 212, thereby drawing more current from node 295 and turning on regulator transistor 270 to raise the value of $V_{DD}$ output by voltage regulation circuit 130. Because $V_{DD}$ at the output of voltage regulation circuit 130 is raised at time 335, the core $V_{DD}$ (sense line 155) and the RAM $V_{DD}$ (sense line 145) are raised, and the value of pad $V_{DD}$ (sense line 185), remains at an operational value throughout period 340.

Referring again to FIG. 2, voltage regulator control circuit 205 is power control enabled. For example, voltage regulator control circuit 205 is coupled to receive a system standby signal (SB) on node 196 which can shut off one or some or all of the opamps of voltage regulator control circuit 205. As illustrated, standby signal SB disables sense lines originating from operational circuits of IC 120, but allows the sense line local to voltage regulation circuit 130. Various different embodiments may include different configurations in which the opamps are selectively disabled (e.g., when portions of IC 120 are selectively disabled for power savings) or in which all opamps are disabled (e.g., during a power saving state).

Figure 4:
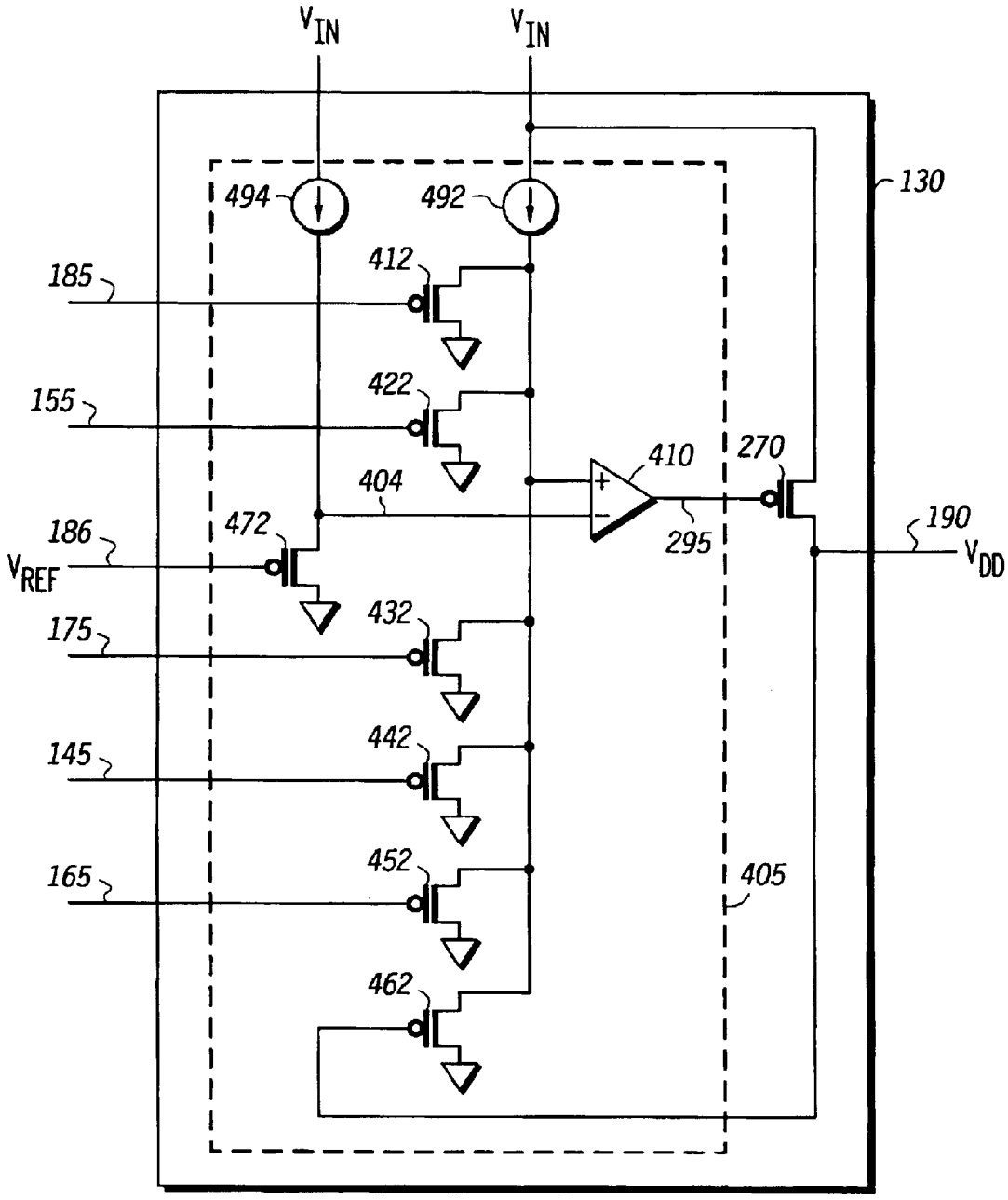
FIG. 4 is a circuit schematic illustrating an alternative exemplary embodiment of the regulator of FIG. 1.

FIG. 4 shows an alternative embodiment of a voltage regulation circuit in which a minimum voltage detection circuit 405 performs the sensing and priority functions using fewer opamps. Specifically, minimum voltage detection circuit 405 includes a single opamp 410 which has an output coupled to the gate of PMOS regulator 270, an inverting input coupled to receive a signal indicative of $V_{REF}$, and a noninverting input coupled to receive a signal indicative of a voltage drop in a portion of IC 120 which is experience the largest voltage drop (e.g., the portion of IC 120 which has priority to request an increase in $V_{DD}$). Each voltage drop indications on sense lines 185, 155, 175, 145 and 185 are received at a respective control terminal of corresponding PMOS transistors 412, 422, 432, 442 and 452. Each of PMOS transistors 412, 422, 432, 442 and 452 pulls current from an input of opamp 410 where the comparison with $V_{REF}$ is made to adjust global $V_{DD}$.

The above description is intended to describe at least one embodiment of the invention. The above description is not intended to define the scope of the invention. Rather, the scope of the invention is defined in the claims below. Thus, other embodiments of the invention include other variations, modifications, additions, and/or improvements to the above description.

For example, in one embodiment, an integrated circuit includes a voltage regulator, a power rail, and a number of sense lines. The voltage regulator has an output to provide a regulated voltage. The power rail (e.g., a voltage rail) is coupled to the output of the voltage regulator to provide the regulated voltage to circuitry of the integrated circuit. Each sense line is coupled to provide an indication of a voltage at a location of a plurality of locations on the power rail during operation. The voltage regulator includes a voltage regulator control circuit coupled to each of the plurality of sense lines. The voltage regulator control circuit has an output to provide a control signal to control the regulated voltage. The voltage regulator control circuit can adjust the control signal such that a minimum voltage of voltages indicated by the indications of the plurality of sense lines meets a voltage reference requirement.

In a further embodiment, the aforementioned integrated circuit further includes a number of operational circuits coupled to the output of the regulator via the voltage rail. Each sense line or each of a subset of the sense lines is coupled to provide an indication of a voltage at a location on the power rail associated with an operational circuit. In still further embodiments, the functional circuits include one or more of a memory, a processor core, a transceiver and a receiver. In another further embodiment, a location on the power rail associated with an operational circuit includes a location within or adjacent to an operational circuit.

In another further embodiment, the voltage regulator control circuit is coupled to receive a reference voltage signal indicating the voltage reference requirement. In yet a further embodiment, the reference voltage signal is generated by a circuit external to the integrated circuit. In another further embodiment, the voltage regulator control circuit includes a plurality of amplifiers, wherein each amplifier has a first input coupled to the voltage reference signal, a second input coupled to a sense line of the plurality, and an output, and the voltage regulator control circuit adjusts the control signal based upon the outputs of the plurality of amplifiers. The voltage control regulator circuit may also include a number of transistors in which the control electrode of each is coupled to an output of an amplifier of the plurality and in which the current electrode of each is coupled to the output of the voltage regulator control circuit. The voltage of the control signal may be determined by the output of an amplifier indicating that an indication received by the sense line coupled to its input indicates the lowest voltage of the voltages indicated by the indications of the sense lines as indicated by the outputs of the amplifiers of the plurality.

In another further embodiment, the voltage regulator control circuit is responsive to a reduction voltage of voltages indicated by the indications of a first number of sense lines meets the voltage reference requirement in response to the reduction signal being at a first state. The voltage regulator control circuit can also adjust the control signal such that a minimum voltage of voltages indicated by the indications of a second number of sense lines of the plurality meets the voltage reference requirement in response to the reduction signal being at a second state. This embodiment may include the first number of sense lines, and the second number (e.g., one) may be less than the first number. In yet a further embodiment, the voltage regulator control circuit includes a plurality of amplifiers, wherein each amplifier has a first input coupled to the voltage reference signal, a second input coupled to a sense line of the plurality, and an output, and wherein the voltage regulator control circuit adjusts the control signal based upon the outputs of the plurality of amplifiers. The set of amplifiers (e.g., the first number minus the second number of amplifiers) may be disabled in response to the reduction signal being at the second state.

In another further embodiment, the voltage regulator control circuit includes a minimum voltage detection circuit having an out put to provide and indication of the minimum voltage. The minimum voltage detection circuit may include a plurality of transistors such that for each transistor, the control electrode i s coupled to receive an indication of a voltage indicated by a sense line of the plurality and the current electrode of each of the plurality of transistors is coupled to the output of the minimum voltage detection circuit. The voltage regulator control circuit may further include an amplifier having a first input coupled to the output of the minimum voltage detection circuit, a second input coupled to receive a reference voltage signal indicating the voltage reference requirement, and an output coupled to the output of the voltage regulator control circuit. The output of the minimum voltage detection circuit may be coupled to the output of the voltage regulation control circuit. The control signal may be dependent upon the output of the minimum voltage detection circuit.

In another further embodiment, the integrated circuit further includes a pass device having a first current electrode coupled to the output of the voltage regulator, a control electrode coupled to the output of the voltage regulator control circuit, and a second current electrode coupled to a power supply.

In another embodiment, an electric system includes one or more of the integrated circuit embodiments described herein. The electric system further includes a power supply having an output for supplying a first power supply voltage, and the voltage regulator is coupled to the power supply to received the power supply voltage.

In another embodiment, a method for controlling a regulated voltage of a voltage regulator of an integrated circuit is provided. The integrated circuit includes a power rail coupled to an output of the voltage regulator. The method includes the step of sensing one or more voltages on the power rail at a plurality of locations on the power rail and determining a minimum voltage of the voltages sensed in the sensing. The regulated voltage is adjusted such that the minimum voltage meets a voltage reference requirement. The steps of sensing, determining, and adjusting are performed by circuitry of the integrated circuit.

One embodiment of the method for controlling the regulated voltage of the voltage regulator may include the step of comparing the voltage with a reference voltage to obtain a voltage difference for each location of the plurality of locations. In such an embodiment, the step of determining the minimum voltage includes determining the minimum voltage based upon the voltage differences obtain from each location.

Another embodiment of the method includes the step of receiving a reduction signal and includes various other characteristics. For example, the step of determining further includes determining the minimum voltage of the voltages sensed at the first number of the plurality of locations in response to the reduction signal being at a first state, and determining the minimum voltage of the voltages sensed at a second number of the plurality of locations in response to a the reduction signal being at a second state, wherein the plurality of locations is of a first number, and the second number is less than the first number.

In another embodiment of the method, the step of determining further includes providing an indication of the minimum voltage, and the step of adjusting further includes providing a control signal dependent upon the indication of the minimum voltage for controlling the regulated voltage.

In another embodiment, an integrated circuit includes a voltage regulator, a power rail, and a number of sense lines. The voltage regulator has an output to provide a regulated voltage. The power rail is coupled to the output of the voltage regulator to provide the regulated voltage to circuitry of the integrated circuit. Each sense line provides an indication of a voltage at a location on the power rail. The voltage regulator includes means for controlling the regulated voltage such that a minimum voltage of voltages indicated by the indications of the plurality of sense lines meets a voltage reference requirement, wherein the means is responsive to the plurality of sense lines. In a further embodiment, the integrated circuit further includes a plurality of operational circuits coupled to the output of the regulator via the voltage rail, wherein each sense line of a plurality of at least a portion of the plurality of the sense lines provides an indication of a voltage at a location on the power rail associated with an operational circuit of the plurality.

In another embodiment, an integrated circuit includes a voltage regulator, a power rail, and a plurality of sense lines. The voltage regulator has an output to provide a regulated voltage. The power rail is coupled to the output of the voltage regulator to provide the regulated voltage to circuitry of the integrated circuit. Each of the plurality of sense lines is configured to provide an indication of a voltage at a location of a plurality of locations on the power rail. The voltage regulator includes a voltage regulator control circuit coupled to each of the plurality of sense lines. The voltage regulator control circuit has an output to provide a control signal to control the regulated voltage. The voltage regulator control circuit includes a minimum voltage detection circuit. The minimum voltage detection circuit is responsive to a first group of indications of voltages in response to a reduction signal being at a first state to provide an indication of the minimum voltage indicated by the first group of indications wherein each indication of the first group is indicative of a voltage at a location of the plurality of locations. The minimum voltage detection circuit is responsive to a second group of at least one indication of voltages in response to the reduction signal being at a second state to provide an indication of the minimum voltage indicated by the second group wherein each indication of the second group is indicative of a voltage at a location of the plurality of locations, the second group being a smaller number than the first group. The voltage regulator control circuit adjusts the control signal such that the minimum voltage as indicated by the minimum voltage detection circuit meets a voltage reference requirement. In a further embodiment, the second group includes only one indication.

Those skilled in the art will recognize that circuit elements in circuit diagrams and boundaries between logic blocks are merely illustrative and to some extent perhaps even artificial, and that such logic demarcations are often offered for instruction rather than to indicate any physical demarcation. Alternative embodiments may merge logic blocks or circuit elements or impose an alternate decomposition of functionality upon various logic blocks or circuit elements. Moreover, alternative embodiments may combine multiple instances of a particular component.

The foregoing components and devices are used herein as examples for sake of conceptual clarity. As for (nonexclusive) example, the depiction of a MOSFET transistor is representative of any type of switching device or circuit which may be appropriately employed to achieve the same or similar switching functionality. Consequently, as used herein the use of any specific exemplar herein is also intended to be representative of its class and the noninclusion of any specific devices in any exemplary lists herein should not be taken as indicating that limitation is desired.

The transistors described herein (whether bipolar, field effect, etc.) may be conceptualized as having a control terminal which controls the flow of current between a first current handling terminal and a second current handling terminal. An appropriate condition on the control terminal causes a current to flow from/to the first current handling terminal and to/from the second current handling terminal.

For example, in a bipolar NPN transistor, the first current handling terminal is the collector, the control terminal is the base, and the second current handling terminal is the emitter. A sufficient current into the base causes a collector-to-emitter current to flow. In a bipolar PNP transistor, the first current handling terminal is the emitter, the control terminal is the base, and the second current handling terminal is the collector. A current flowing between the base and emitter causes an emitter-to-collector current to flow.

Also, although field effect transistors (FETs) are frequently discussed as having a drain, a gate, and a source, in most such devices the drain is interchangeable with the source. This is because the layout and semiconductor processing of the transistor is frequently symmetrical. For an n-channel FET, the current handling terminal normally residing at the higher voltage is customarily called the drain. The current handling terminal normally residing at the lower voltage is customarily called the source. A sufficient voltage on the gate (relative to the source voltage) causes a current to therefore flow from the drain to the source. The source voltage referred to in n-channel FET device equations merely refers to which drain or source terminal has the lower voltage at any given point in time. For example, the "source" of the n-channel device of a bi-directional CMOS transfer gate depends on which side of the transfer gate is at the lower voltage. To reflect this symmetry of most n-channel FET devices, the control terminal may be deemed the gate, the first current handling terminal may be termed the "drain/source", and the second current handling terminal may be termed the "source/drain". Such a description is equally valid for a p-channel FET device, since the polarity between drain and source voltages, and the direction of current flow between drain and source, is not implied by such terminology. Alternatively, one current-handling terminal may arbitrarily deemed the "drain" and the other deemed the "source", with an implicit understanding that the two are not distinct, but interchangeable.

Insulated gate FETs (IGFETs) are commonly referred to as MOSFET devices (which literally is an acronym for "Metal-Oxide-Semiconductor Field Effect Transistor"), even though the gate material may be polysilicon or some material other than metal, and the dielectric may be oxynitride, nitride, or some material other than an oxide. The use of such historical legacy terms as MOSFET should not be interpreted to literally specify a metal gate FET having an oxide dielectric unless the context indicates that such a restriction is intended.

Because the above detailed description is exemplary, when "one embodiment" is described, it is an exemplary embodiment. Accordingly, the use of the word "one" in this context is not intended to indicate that one and only one embodiment may have a described feature. Rather, many other embodiments may, and often do, have the described feature of the exemplary "one embodiment." Thus, as used above, when the invention is described in the context of one embodiment, that one embodiment is one of many possible embodiments of the invention.

Notwithstanding the above caveat regarding the use of the words "one embodiment" in the detailed description, it will be understood by those within the art that if a specific number of an introduced claim element is intended in the below claims, such an intent will be explicitly recited in the claim, and in the absence of such recitation no such limitation is present or intended. For example, in the claims below, when a claim element is described as having "one" feature, it is intended that the element be limited to one and only one of the feature described. Furthermore, when a claim element is described in the claims below as including or comprising "a" feature, it is not intended that the element be limited to one and only one of the feature described. Rather, for example, the claim including "a" feature reads upon an apparatus or method including one or more of the feature in question. That is, because the apparatus or method in question includes a feature, the claim reads on the apparatus or method regardless of whether the apparatus or method includes another such similar feature. This use of the word "a" as a nonlimiting, introductory article to a feature of a claim is adopted herein by Applicants as being identical to the interpretation adopted by many courts in the past, notwithstanding any anomalous or precedential case law to the contrary that may be found. Similarly, when a claim element is described in the claims below as including or comprising an aforementioned feature (e.g., "the" feature), it is intended that the element not be limited to one and only one of the feature described merely by the incidental use of the definite article.

Furthermore, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

While particular embodiments of the present invention have been shown and described, it will be obvious to those skilled in the art that, based upon the teachings herein, various modifications, alternative constructions, and equivalents may be used without departing from the invention claimed herein. Consequently, the appended claims encompass within their scope all such changes, modifications, etc. as are within the true spirit and scope of the invention. Furthermore, it is to be understood that the invention is solely defined by the appended claims. The above description is not intended to present an exhaustive list of embodiments of the invention. Unless expressly stated otherwise, each example presented herein is a nonlimiting or nonexclusive example, whether or not the terms nonlimiting, nonexclusive or similar terms are contemporaneously expressed with each example. Although an attempt has been made to outline some exemplary embodiments and exemplary variations thereto, other embodiments and/or variations are within the scope of the invention as defined in the claims below.

What is claimed is:

1. An integrated circuit comprising:

a voltage regulator having an output to provide a regulated voltage;

a power rail coupled to the output of the voltage regulator to provide the regulated voltage to remote circuitry of the integrated circuit; and a plurality of sense lines, each sense line providing an indication of a voltage at a corresponding remote circuitry location of a plurality of locations on the power rail;

wherein the voltage regulator includes a voltage regulator control circuit coupled to each of the sense lines, the voltage regulator control circuit having an output to provide a control signal to control the regulated voltage on the power rail, the voltage regulator control circuit adjusting the control signal in response to the indications of the plurality of sense lines such that a minimum voltage of voltages indicated by the indications of the plurality of sense lines meets a voltage reference requirement.

2. The integrated circuit of claim 1 further comprising:

a plurality of operational circuits coupled to the output of the regulator via the voltage rail, wherein each sense line of a plurality of at least a portion of the plurality of the sense lines provides an indication of a voltage at a location on the power rail associated with an operational circuit of the plurality.

3. The integrated circuit of claim 2 wherein the plurality of functions circuits includes at least one of a memory, a processor core, a transceiver or a receiver.

4. The integrated circuit of claim 2 wherein a location on the power rail associated with an operational circuit of the plurality includes a location within an operational circuit of the plurality.

5. The integrated circuit of claim 2 wherein a location on the power rail associated with an operational circuit of the plurality includes a location adjacent an operational circuit of the plurality.

6. The integrated circuit of claim 1 wherein:

the voltage regulator control circuit receives a reference voltage signal indicating the voltage reference requirement;

the voltage regulator control circuit includes a plurality of amplifiers, wherein each amplifier of the plurality has a first circuit coupled to the reference voltage signal, a second input coupled to a sense line of the plurality, and an output;

the voltage regulator control circuit adjusts the control signal based upon the output of the plurality of amplifiers.

7. The integrated circuit of claim 6, wherein the reference voltage signal is generated by a circuit external to the integrated circuit.

8. The integrated circuit of claim 6, wherein the voltage control regulator circuit further comprises:

a plurality of transistors, each of the plurality of transistors includes a control electrode and a current electrode, wherein for each transistor of the plurality, the control electrode is coupled to an output of an amplifier of the plurality, wherein the current electrode of each of the plurality of transistors is coupled to the output of the voltage regulator control circuit.

9. The integrated circuit of claim 6, wherein the voltage of the control signal is determined by the output of an amplifier of the plurality of amplifiers indicating that an indication received by the sense line coupled to its input indicates the lowest voltage of the voltages indicated by the indications of the plurality of sense lines as indicated by the outputs of the amplifiers of the plurality.

10. The integrated circuit of claim 1 wherein:

the voltage regulator control circuit is responsive to a reduction signal;

the plurality of sense lines is of a first number;

the voltage regulator control circuit adjusts the control signal such that a minimum voltage of voltages indicated by the indications of a first number of sense lines of the plurality meets the voltage reference requirement in response to the reduction signal being at a first state;

the voltage regulator control circuit adjusts the control signal such that a minimum voltage of voltages indicated by the indications of a second number of sense lines of the plurality meets the voltage reference requirement in response to the reduction signal being at a second state;

the second number is less than the first number.

11. The integrated circuit of claim 10 wherein the reduction signal is a stand by signal whose second state indicates a low power mode.

12. The integrated circuit of claim 10, wherein the reduction signal is generated by a circuit external to the integrated circuit.

13. The integrated circuit of claim 10 wherein the voltage regulator control circuit includes a plurality of amplifiers, wherein each amplifier has a first input coupled to the voltage reference signal, a second input coupled to a sense line of the plurality, and an output;

the voltage regulator control circuit adjusts the control signal based upon the outputs of the plurality of amplifiers;

wherein the first number minus the second number of the plurality of amplifiers are disabled in response to the reduction signal being at the second state.

14. The integrated circuit of claim 1 wherein the voltage regulator control circuit furthers comprises:

a minimum voltage detection circuit, the minimum voltage detection circuit having an output to provide an indication of the minimum voltage.

15. The integrated circuit of claim 14 wherein the minimum voltage detection circuit includes a plurality of transistors, each of the plurality of transistors includes a control electrode and a current electrode, wherein for each transistor of the plurality, the control electrode is coupled to receive an indication of a voltage indicated by a sense line of the plurality, wherein the current electrodes of each of the plurality of transistors is coupled to the output of the minimum voltage detection circuit.

16. The integrated circuit of claim 15 wherein the voltage regulator control circuit further comprises:

an amplifier having a first input coupled to the output of the minimum voltage detection circuit, a second input coupled to receive a reference voltage signal indicating the voltage reference requirement, and an output coupled to the output of the voltage regulator control circuit.

17. The integrated circuit of claim 15 wherein the output of the minimum voltage detection circuit is coupled to the output of the voltage regulation control circuit.

18. The integrated circuit of claim 14 wherein the control signal is dependent upon the output of the minimum voltage detection circuit.

19. The integrated circuit of claim 1 further comprising:

a pass device having a first current electrode coupled to the output of the voltage regulator, a control electrode coupled to the output of the voltage regulator control circuit, and a second current electrode coupled to a power supply.

20. An electric system comprising the integrated circuit of claim 1 and further comprising:

a power supply having an output for supplying a first power supply voltage, wherein the voltage regulator is coupled to the power supply to received the power supply voltage.

21. A method for controlling a regulated voltage of a voltage regulator of an integrated circuit, the integrated circuit including a power rail coupled to an output of the voltage regulator, the method comprising:

sensing a voltage on the power rail at a plurality of remote circuitry locations on the power rail and internal to the integrated circuit;

determining a minimum voltage of the voltages sensed in the sensing at the remote circuitry locations; and adjusting the regulated voltage on the power rail in response to the sensed voltages at the plurality of remote circuitry locations such that the minimum voltage meets a voltage reference requirement, wherein the sensing, the determining, and the adjusting are performed by circuitry of the integrated circuit.

22. The method of claim 21 further comprising:

comparing for each location of the plurality of locations, the voltage with a reference voltage to obtain a voltage difference;

wherein the determining the minimum voltage includes determining the minimum voltage based upon the voltage differences obtain from each location.

23. The method of claim 21 further comprising:

receiving a reduction signal;

wherein the plurality of locations is of a first number;

wherein the determining further includes determining the minimum voltage of the voltages sensed at the first number of the plurality of locations in response to the reduction signal being at a first state;

wherein the determining further includes determining the minimum voltage of the voltages sensed at a second number of the plurality of locations in response to a the reduction signal being at a second state;

the second number is less than the first number.

24. The method of claim 21 wherein:

the determining further includes providing an indication of the minimum voltage;

the adjusting further includes providing a control signal dependent upon the indication of the minimum voltage for controlling the regulated voltage.

25. An integrated circuit comprising:

a voltage regulator having an output to provide a regulated voltage;

a power rail coupled to the output of the voltage regulator to provide the regulated voltage to remote circuitry of the integrated circuit; and a plurality of sense lines, each sense line providing an indication of a voltage at a corresponding remote circuitry location of a plurality of locations on the power rail;

wherein the voltage regulator includes means for controlling the regulated voltage on the power rail such that a minimum voltage of voltages indicated by the indications of the plurality of sense lines meets a voltage reference requirement, wherein the means is responsive to the indications of the plurality of sense lines.

26. The integrated circuit of claim 25 further comprising:

a plurality of operational circuits coupled to the output of the regulator via the voltage rail, wherein each sense line of a plurality of at least a portion of the plurality of the sense lines provides an indication of a voltage at a location on the power rail associated with an operational circuit of the plurality.

* * * * *

UNITED STATES PATENT AND TRADEMARK OFFICE

CERTIFICATE OF CORRECTION

PATENT NO. : 6,906,582 B2
APPLICATION NO. : 10/652530
DATED : June 14, 2005
INVENTOR(S) : Kiyoshi Kase It is certified that error appears in the above-identified patent and that said Letters Patent is hereby corrected as shown below:

Column 11, Line 9, Claim No. 6:

Change “circuit” to --input--

Column 11, Line 13, Claim No. 6:

Change “output” to --outputs--

Signed and Sealed this

Thirty-first Day of July, 2007

JON W. DUDAS
*Director of the United States Patent and Trademark Office*